United States Patent [19]

Kendrick

[11] 4,122,917

[45] Oct. 31, 1978

[54] FIRE RESCUE EQUIPMENT

[76] Inventor: Theodore T. Kendrick, 1615 NW. 130th St., Miami, Fla. 33167

[21] Appl. No.: 809,158

[22] Filed: Jun. 23, 1977

[51] Int. Cl.[2] ..... A62B 1/02

[52] U.S. Cl. ..... 182/144; 182/10; 182/63

[58] Field of Search ..... 182/10, 142, 143, 144, 182/191, 192, 193, 63, 36, 37; 212/55; 187/6, 7

[56] References Cited

U.S. PATENT DOCUMENTS

| | | | |
|---|---|---|---|
| 241,509 | 5/1881 | Payne | 182/142 |
| 538,615 | 4/1895 | Lindsay | 182/142 |
| 560,086 | 5/1896 | Dobkins | 212/55 |
| 1,125,918 | 1/1915 | Shaules | 182/70 |

FOREIGN PATENT DOCUMENTS

| | | | |
|---|---|---|---|
| 69,304 | 7/1893 | Fed. Rep. of Germany | 182/10 |

*Primary Examiner*—Reinaldo P. Machado

[57] ABSTRACT

Fire rescue equipment for mounting on the roof of a building which includes a boom which is rotatably mounted on the roof for swinging movement over the edge of the roof and on which boom there is a pulley with a cable which is raised and lowered toward ground level and which carries a basket which is connected to the cable and a guide is provided in the form of a tie line which is connected to the cable to guide the basket away from and toward the building so that the basket may be pulled outwardly from the building by a truck at ground level.

7 Claims, 5 Drawing Figures

FIRE RESCUE EQUIPMENT

FIELD OF THE INVENTION

This invention relates to fire rescue equipment.

BACKGROUND OF THE INVENTION

In numerous buildings, especially those above seven or ten stories in height, it is very difficult to remove people in the event of a fire. This invention is of a device which can be installed on the roof of a highrise building and which includes a beam which is rotatable and, preferably, extendible, so that the distal or terminal end will extend over the edge of the building and the boom is provided with a pulley operating a cable to which a basket is connected and which includes a depending guideline, so that the basket may be raised and lowered and manipulated from ground level.

It is, accordingly, an object of this invention to provide an improved fire rescue equipment which is adapted to be mounted on the the roof of a building and which has a swingable boom with a depending cable and a carriage connected to the cable to be raised and lowered for the purpose of moving it toward or away from a building so that people may be rescued.

In accordance with these and other objects which will become apparent hereinafter the instant invention will now be described with reference to the accompanying drawings, in which:

DESCRIPTION OF THE PREFERRED EMBODIMENT

Figure 1:
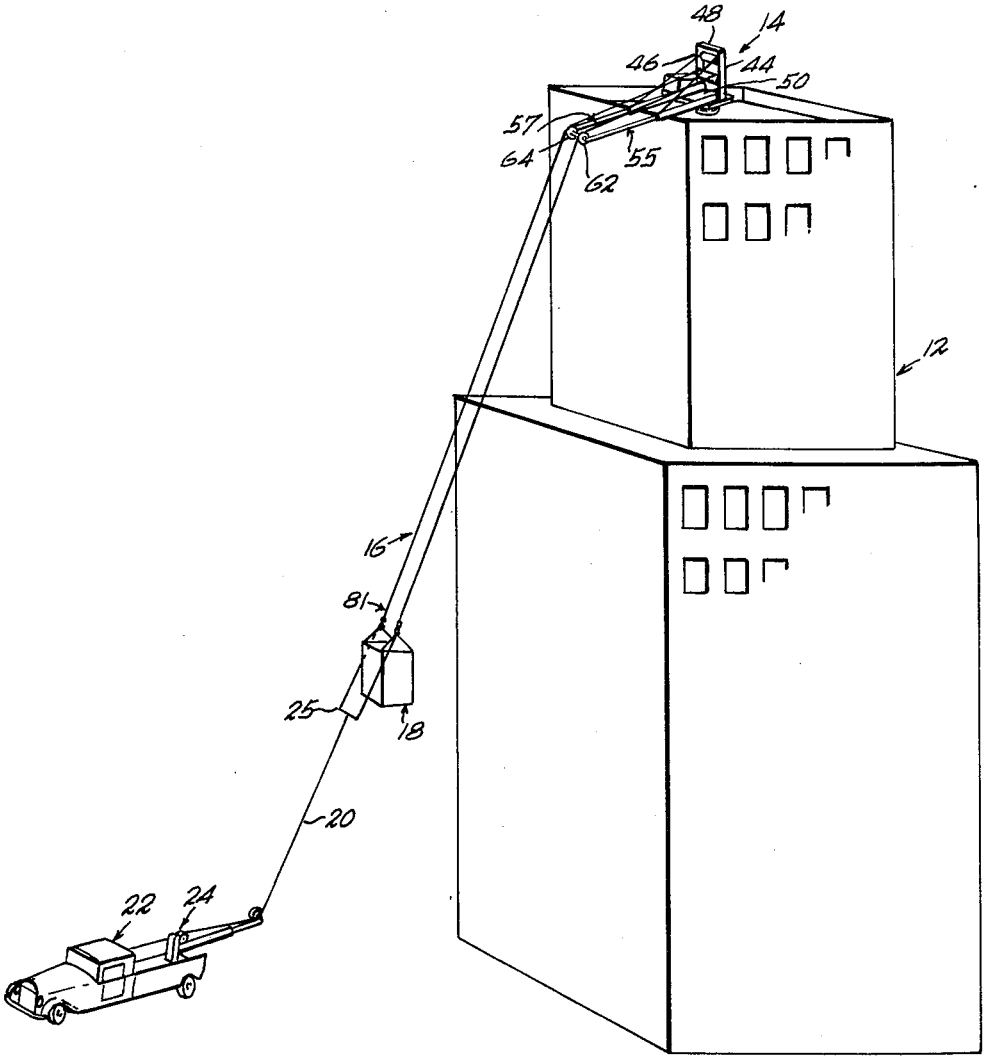
FIG. 1 is a perspective view of a building equipped with the instant invention.

Referring to the drawings wherein like reference characters designate like or corresponding parts throughout the several views there is shown a building 12 with a boom generally designated by the numeral 14 from which cable means 16 are dropped and which carry a rescue basket 18 which is held in an angular position by a tow line 20 on a truck 22 with a winch 24 with the line being connected to a yoke 25 on the rescue basket.

Figure 2:
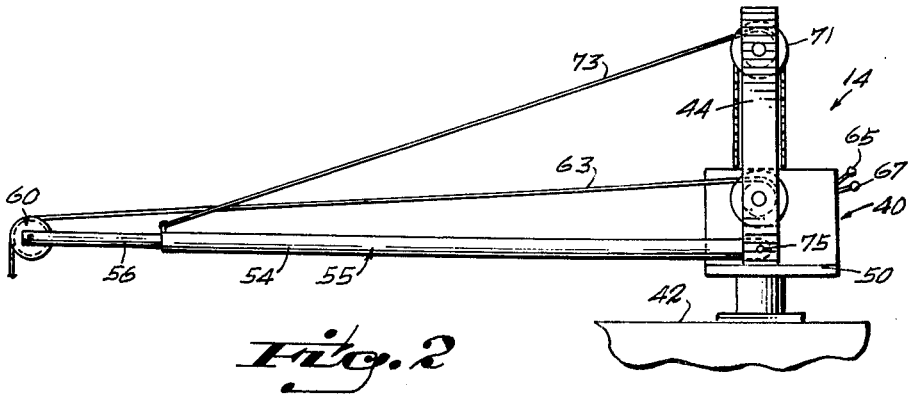
FIG. 2 is a side elevation view of the upper zone of FIG. 1.

Referring to FIG. 2, it is seen that the boom 14 includes a turntable 40 which is mounted by suitable means to the top 42 of the building. The turntable includes, preferably, a pair of spaced upstanding boom supports 44 and 46 which may be spanned at the upper ends by a lateral member 48 and a platform or support 50 from which there extend outwardly a pair of spaced boom arms 55 and 57. In the preferred embodiment the boom arms are extendible having their inner portion 56 and an outer portion 54 as shown in FIG. 2. To the outer portion a pulley means 60 which may include a first and a second pulley 62 and 64 are provided. These pulleys are connected to a drive pulley 61 through cables 63.

In use, the turntable is operated by means of operator switches such as 65 and 67 to cause the boom to swing about a vertical axis of the turntable so that the boom end 54 extends outwardly of the side of the building. Thereafter, the switches are operated to cause the pulley to feed the cable 63 outwardly and downwardly as shown in FIG. 1.

In the preferred embodiment a pulley 71 is provided with a cable 73 to raise and lower the boom which is pivotally connected to the upright beam supports as at 75 in a pivotal connection, so that, if there are any obstructions on the roof, the boom may be raised and lowered appropriately to turn around them. When the lower ends of the cables designated by the numeral 81 is lowered, a basket, such as designated by the numeral 18 is connected to them by suitable hooks and through the yoke 25 it is connected to the line 20 which pulls it outwardly well clear of the building. The cables are of steel.

Figure 3:
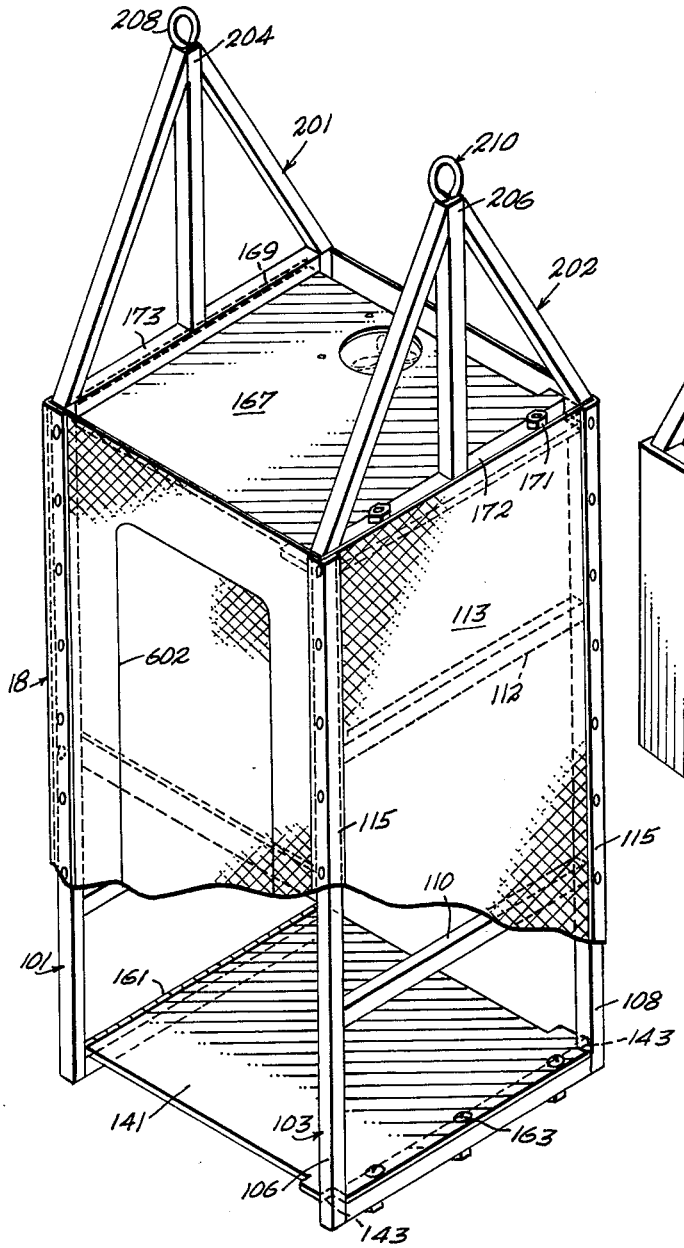
FIG. 3 is a perspective view of a basket for use in accordance with the invention described hereinafter.

Referring to the rescue basket itself, this is seen in FIG. 3. It includes a pair of side frames, a left side frame 101 and a right side frame 103. The side frames include vertical members such as 106 and 108 which are spanned by suitable struts such as 110 and 112 and the frame is enclosed by a canvas sheet 113 sized to fit it and which is secured by suitable means such as the keeper means of angle iron shown and designated by the numeral 115. The left side frame member 110 includes a floor 141 which is suitable cutout and knotched as at 143 and is sized to span the left and side portions, being hingedly connected to the left-hand portion as at 161 and bolted to the right-hand portion as at 163. A top 167 may be provided in a like manner which is hingedly connected as at 169 and bolted as at 171. From the upper member 172 and the corresponding member 173, upstanding braces 201 and 202 may be provided which converge to an apex zone 204 and 206 with a loop 208 and 210 for hooks to engage the bight of the cable as at 81.

Figure 5:
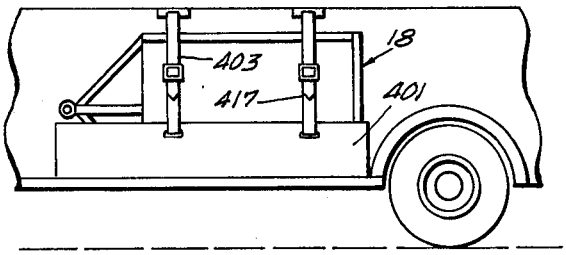
FIG. 5 is a partial view of a rear end of a fire engine truck and illustrating storage of the instant invention.

When stored, the floor and lid 167 are hingedly folded into what may be generally considered as coplanar relation with the left side portion of the basket, and the canvas surfaces being collapsible are such that, when the roof and floor are folded into coplanar relation with the left-hand portion the right-hand portion overlays it. The same may be readily stored in a suitable box as at 401 in FIG. 5 on a fire engine and strapped as by the straps 403 and 417 to hold them for use.

Figure 4:
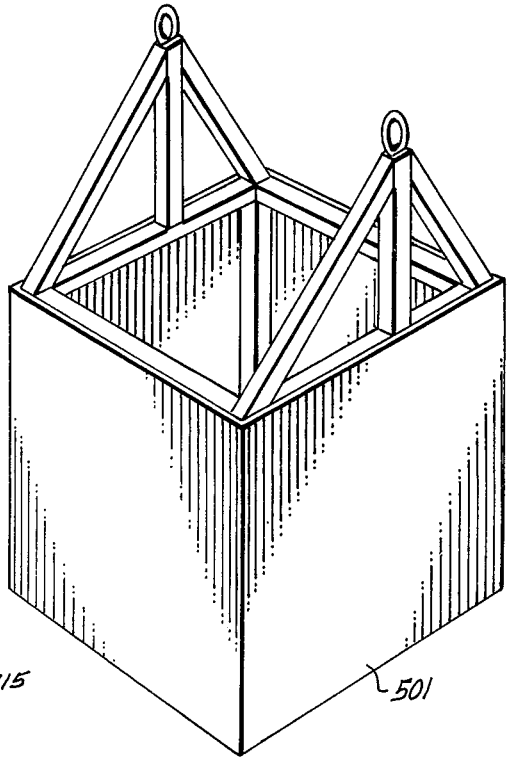
FIG. 4 is a slightly modified view and similar to FIG. 3.

Referring to FIG. 4, an alternative embodiment showing a rigid basket 501 may be employed which is otherwise similar to that described above and which can be used for cleaning the exterior of the building or for painting, etc.

In a preferred embodiment the device is adapted to be remotely controlled from a fire truck to swing it to the correct position, lower the cable, and thereafter, raise and lower the basket, once it has been removed from a fire truck and connected to the device, so that by moving the truck inwardly or outwardly, any located window may be reached by the basket so that persons seeking to escape simply unzip the zippered opening, see 602 of FIG. 1, enter the basket, and it is then lowered to rescue the person.

The boom may be operated by remote control from ground level so that it is not necessary for there to be an operator on the top of the building.

What is claimed is:

1. Fire rescue equipment for mounting on the roof of a building comprising:

(a) a boom including means to rotatably mount the boom to the roof, (b) said boom including pulley means and cable means including means to raise and lower the cable means toward ground level upon operation of the pulley means;

(c) a basket including means to connect to the cable; and (d) a guide means comprising a tie line to be raised and lowered by the cable to guide the basket, said tie line including means to connect to a towing device at ground level to guide the basket toward and away from the building.

2. The device as set forth in claim 1 wherein said guide means includes a yoke having an upper portion connected to the basket in spaced relation and a depending bar with one end of said tie line being connected to said bar.

3. The device as set forth in claim 1 wherein said boom includes a turntable means included in said means to rotatably mount the boom to the roof.

4. The device as set forth in claim 3 wherein said boom includes a pair of upstanding boom supports.

5. The device as set forth in claim 4 wherein said boom supports are spanned by a lateral member.

6. The device as set forth in claim 1 wherein said boom includes a pair of parallel arms and means to extend the arms.

7. The device as set forth in claim 1 wherein said basket includes a collapsible skeletal framework.

* * * * *